US005967499A

United States Patent [19]

McCraw et al.

[11] Patent Number: 5,967,499

[45] Date of Patent: Oct. 19, 1999

[54] BOX SPRING SUPPORT MODULE

[75] Inventors: Kevin Noel McCraw, Burnsville; Benjamin Lewis Ray, Marshall; Darryl Wayne Whitson, Burnsville, all of N.C.

[73] Assignee: Hickory Springs Manufacturing Co., Hickory, N.C.

[21] Appl. No.: 08/982,919

[22] Filed: Dec. 2, 1997

[51] Int. Cl.[6] ..... F16F 3/00; A47C 23/02

[52] U.S. Cl. ..... 267/103; 5/247; 5/255

[58] Field of Search ..... 267/103, 104, 267/106, 165; 5/247, 255, 719

[56] References Cited

U.S. PATENT DOCUMENTS

| | | | |
|---|---|---|---|
| 2,415,765 | 2/1947 | Schmidt . | |
| 2,560,842 | 7/1951 | Blumensaadt et al. | 267/106 |
| 3,286,281 | 11/1966 | Slominski . | |
| 3,546,723 | 12/1970 | Ciampa et al. . | |
| 3,725,965 | 4/1973 | Smith et al. . | |
| 3,777,322 | 12/1973 | Larkin . | |
| 3,916,463 | 11/1975 | Higgins . | |
| 4,069,525 | 1/1978 | Valoff . | |
| 4,251,892 | 2/1981 | Hancock . | |
| 4,339,834 | 7/1982 | Mizelle . | |
| 4,377,279 | 3/1983 | Schulz, Jr. et al. . | |
| 4,398,705 | 8/1983 | Mizelle . | |
| 4,452,438 | 6/1984 | Hancock et al. . | |
| 4,470,584 | 9/1984 | Mizelle . | |
| 4,489,450 | 12/1984 | Miller . | |
| 4,559,654 | 12/1985 | Mizelle . | |
| 4,577,841 | 3/1986 | Hagemeister . | |
| 4,595,181 | 6/1986 | Hagemeister . | |
| 4,620,336 | 11/1986 | Miller . | |
| 4,654,905 | 4/1987 | Miller . | |
| 4,666,136 | 5/1987 | Hagemeister . | |
| 4,685,659 | 8/1987 | Hagemeister . | |
| 4,704,752 | 11/1987 | Yates et al. . | |
| 4,721,290 | 1/1988 | Hagemeister . | |
| 4,729,550 | 3/1988 | Hagemeister . | |
| 4,730,357 | 3/1988 | Wells . | |
| 4,730,358 | 3/1988 | Zapletal . | |
| 4,739,977 | 4/1988 | Dabney . | |
| 4,760,616 | 8/1988 | Hiatt et al. . | |
| 4,766,625 | 8/1988 | Yates et al. . | |
| 4,770,397 | 9/1988 | Schulz, Jr. . | |
| 4,771,995 | 9/1988 | Wells et al. . | |
| 4,805,883 | 2/1989 | Kitchen | 267/103 |
| 4,862,531 | 9/1989 | Wells . | |
| 4,862,532 | 9/1989 | Wells et al. . | |
| 4,891,853 | 1/1990 | Dabney . | |
| 4,896,386 | 1/1990 | Ogle et al. . | |

(List continued on next page.)

*Primary Examiner*—Robert J. Oberleitner
*Assistant Examiner*—Jeffrey Woller
*Attorney, Agent, or Firm*—Kennedy Covington Lobdell & Hickman

[57] ABSTRACT

A nestable box spring foundation includes support modules each formed of a single length of wire defining a top base, a bottom base, and four straight legs. The top base is welded to a wire grid assembly and includes two upper wire segments each having a straight wire portion and respective first and second curved end portions, each upper wire segment lying in a first plane with the straight wire portions lying in angularly converging mirror image relation to each other, each upper wire segment being spaced from one another with first end portions thereof lying closer together than second end portions thereof. The bottom base includes two straight lower wire segments lying in parallel relation to and in a second plane with one another and a straight cross wire segment fixedly intersecting orthogonally the lower wire segments proximate first ends thereof, with the first plane being parallel with the second plane. A first leg extends from the first end portion of an upper wire segment to a second end of a lower wire segment, a second leg extends from the first end portion of the other upper wire segment to a second end of the other lower wire segment; a third leg extends from the second end portion of the first upper wire segment to a first end of the cross wire segment; and a fourth leg extends from the second end portion of the second upper wire segment to a second end of the cross wire segment.

26 Claims, 7 Drawing Sheets

U.S. PATENT DOCUMENTS

| | | | |
|---|---|---|---|
| 4,903,949 | 2/1990 | Schulz, Jr. . | |
| 4,921,228 | 5/1990 | Lowe . | |
| 4,995,125 | 2/1991 | Dennison . | |
| 5,005,809 | 4/1991 | Harmon . | |
| 5,052,064 | 10/1991 | Hagemeister et al. . | |
| 5,142,716 | 9/1992 | Ogle et al. . | |
| 5,152,509 | 10/1992 | Wells et al. . | |
| 5,165,667 | 11/1992 | Dabney | 267/103 |
| 5,176,367 | 1/1993 | Rodgers et al. | 267/103 |
| 5,178,372 | 1/1993 | Rodgers et al. . | |
| 5,188,344 | 2/1993 | Dabney . | |
| 5,197,155 | 3/1993 | Ogle et al. . | |
| 5,231,712 | 8/1993 | Edwards et al. . | |
| 5,246,210 | 9/1993 | Dabney et al. . | |
| 5,346,188 | 9/1994 | Rodgers et al. . | |
| 5,346,190 | 9/1994 | Dabney . | |
| 5,361,434 | 11/1994 | Hagemeister et al. . | |
| 5,369,822 | 12/1994 | Dennison . | |
| 5,370,374 | 12/1994 | Rodgers et al. . | |
| 5,395,097 | 3/1995 | Dabney et al. . | |
| 5,438,716 | 8/1995 | Dabney . | |
| 5,497,979 | 3/1996 | Schulz, Jr. et al. . | |
| 5,551,104 | 9/1996 | Hartline . | |
| 5,558,315 | 9/1996 | Constantinescu et al. . | |
| 5,562,274 | 10/1996 | Kitchen et al. | 267/103 |
| 5,622,357 | 4/1997 | Schulz, Jr. et al. . | |
| 5,704,595 | 1/1998 | Kitchen et al. | 267/103 |

FIG. 1.
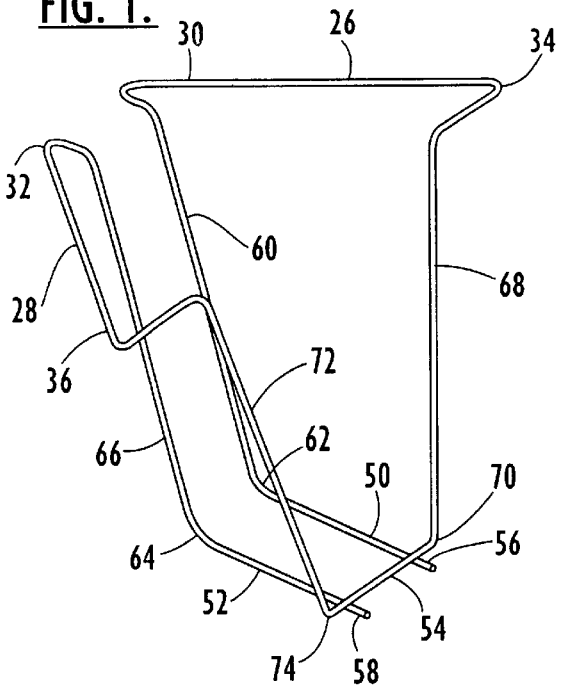
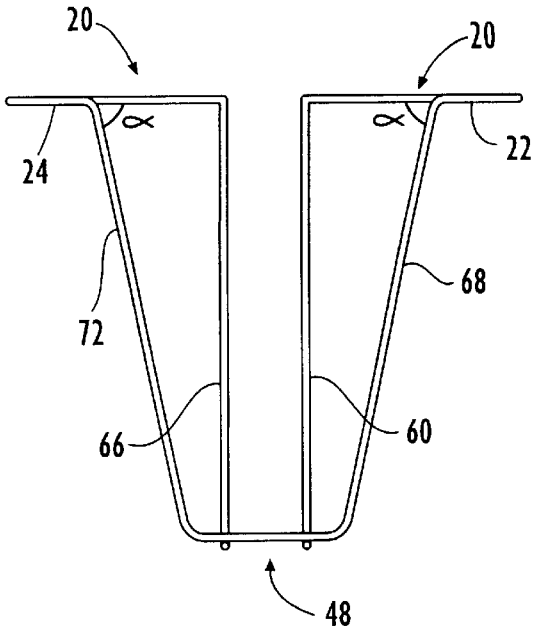
FIG. 2.
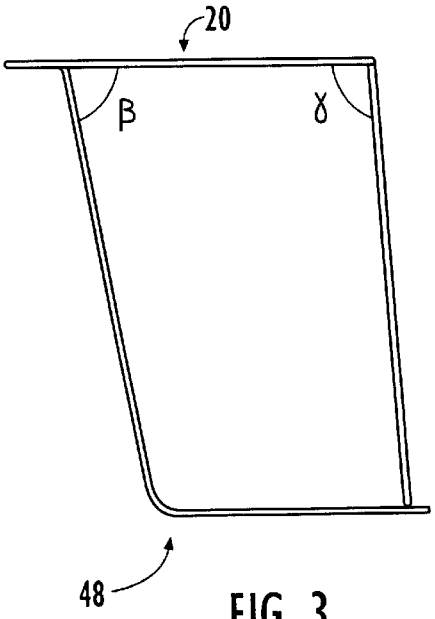
FIG. 3.
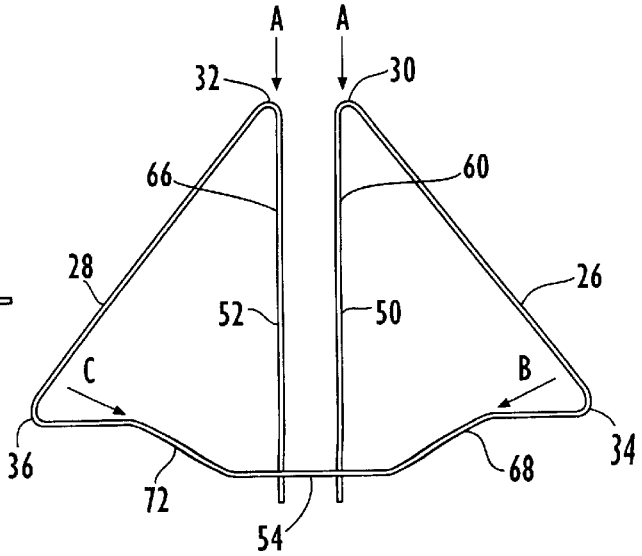
FIG. 4.

FIG. 7.
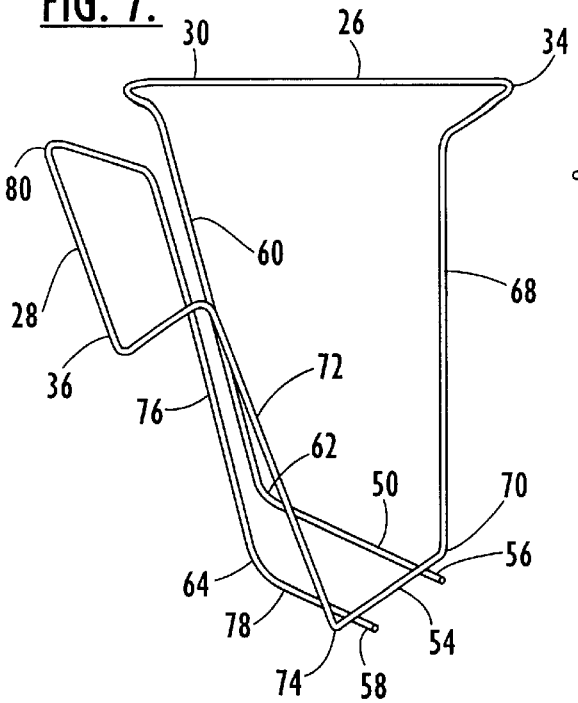
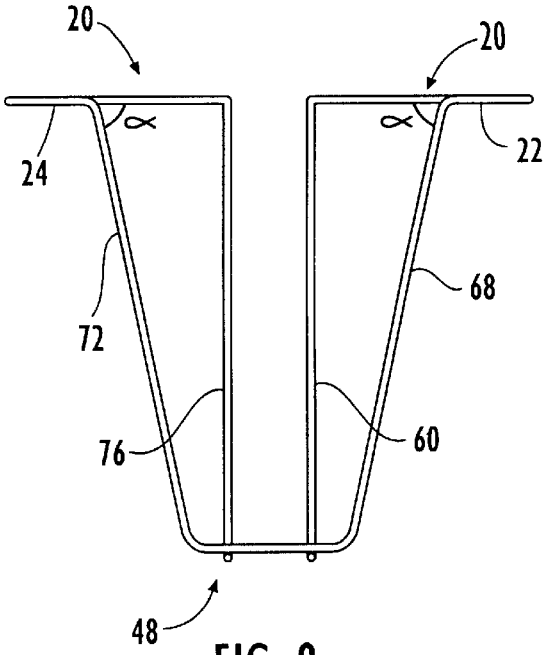
FIG. 8.
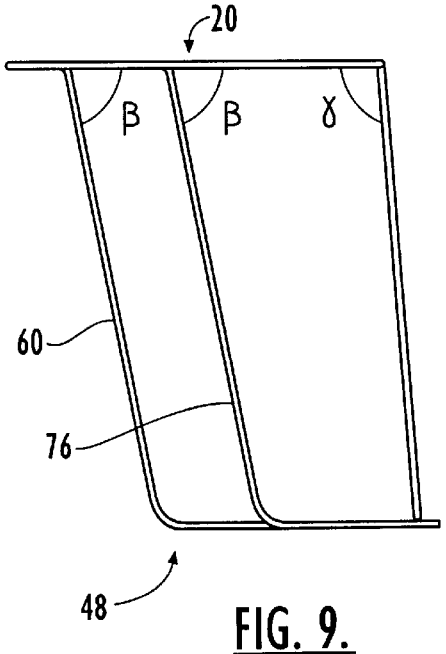
FIG. 9.
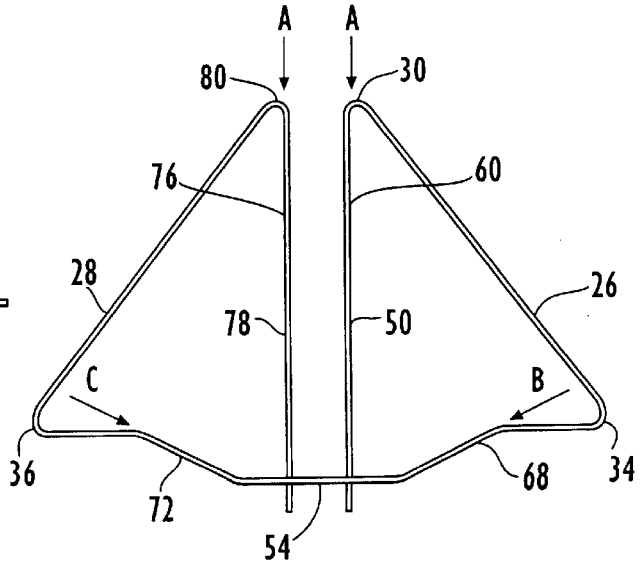
FIG. 10.

FIG. 11.
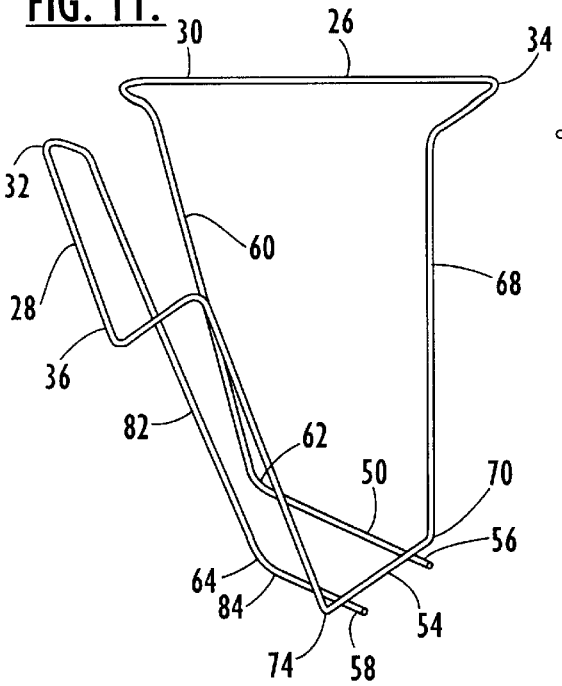
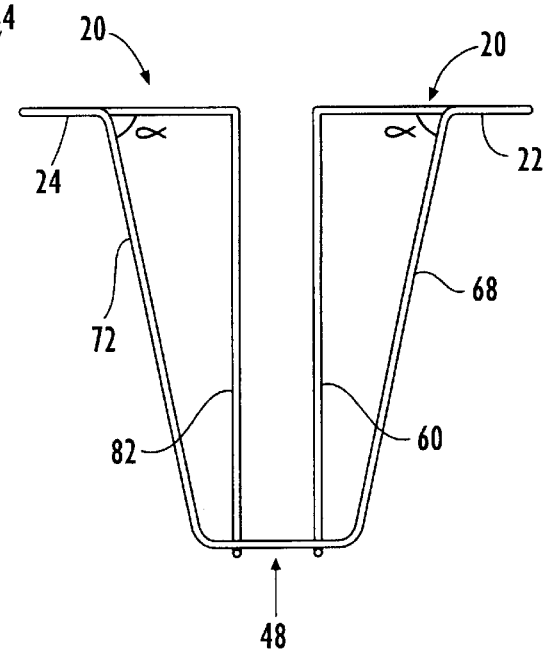
FIG. 12.
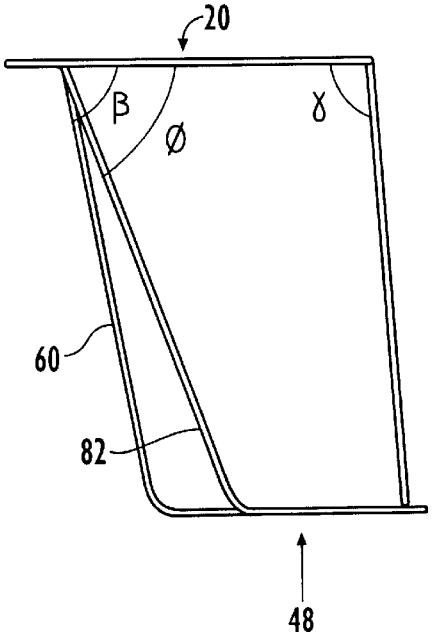
FIG. 13.
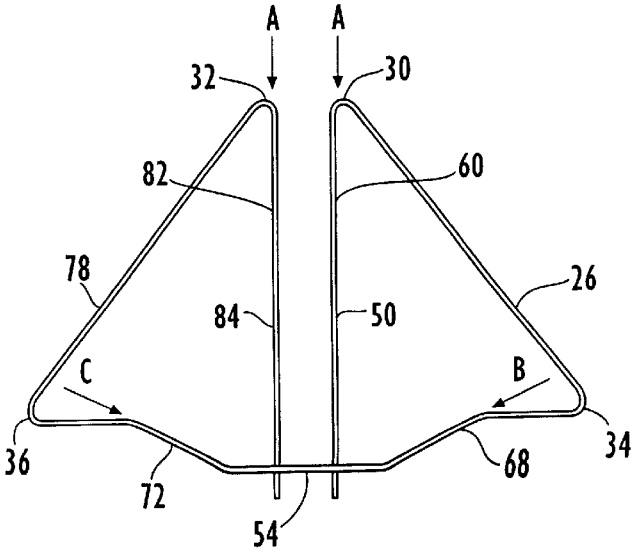
FIG. 14.

FIG. 15.
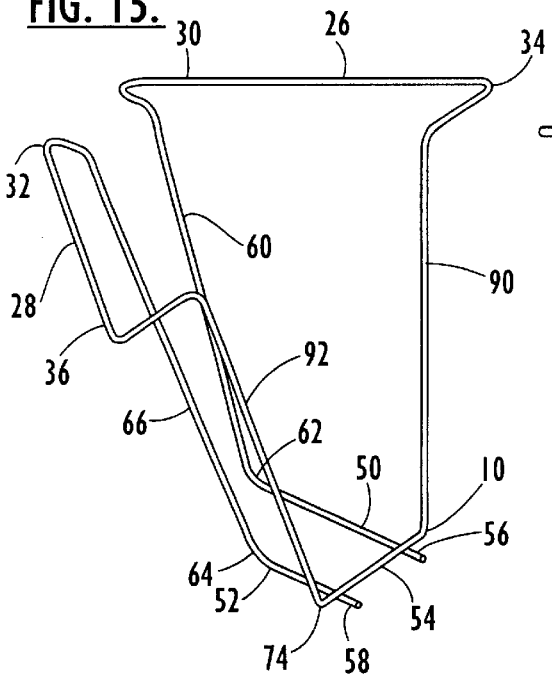
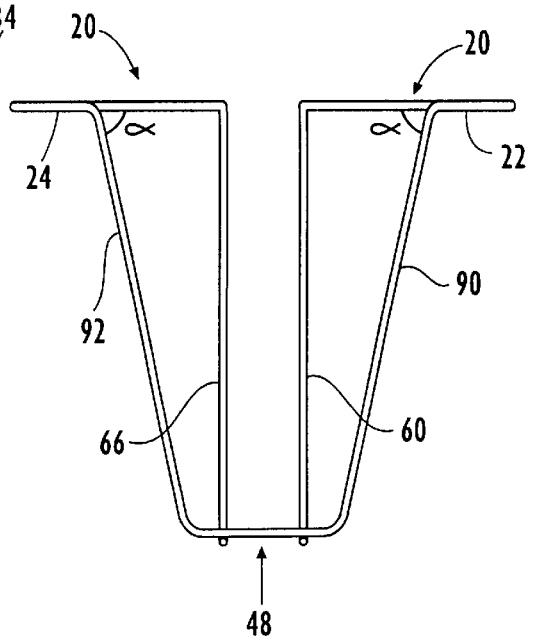
FIG. 16.
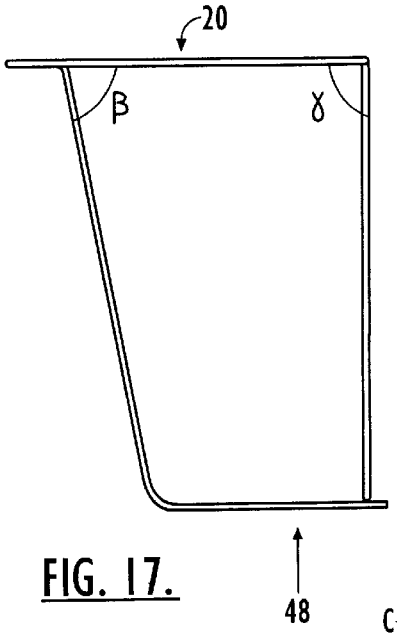
FIG. 17.
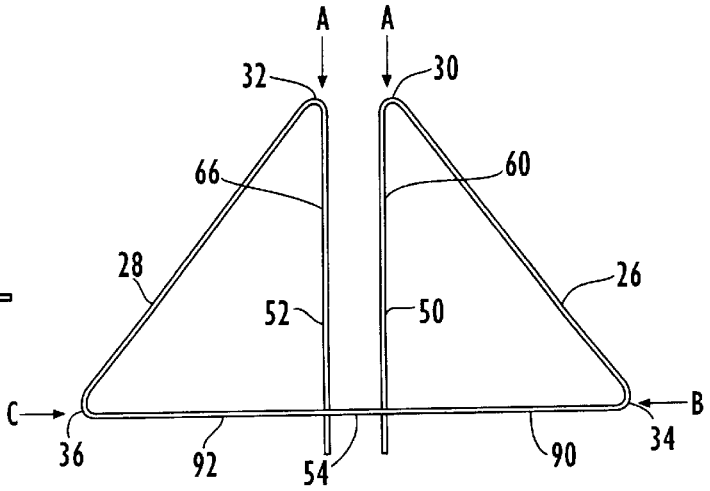
FIG. 18.

FIG. 19.
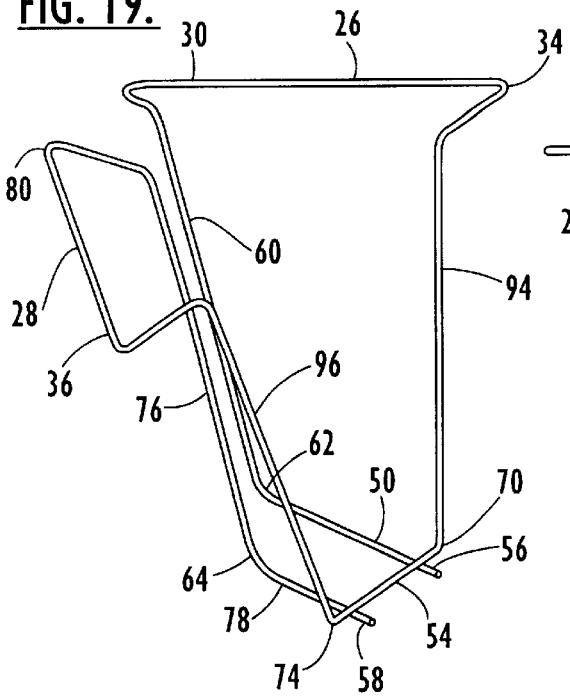
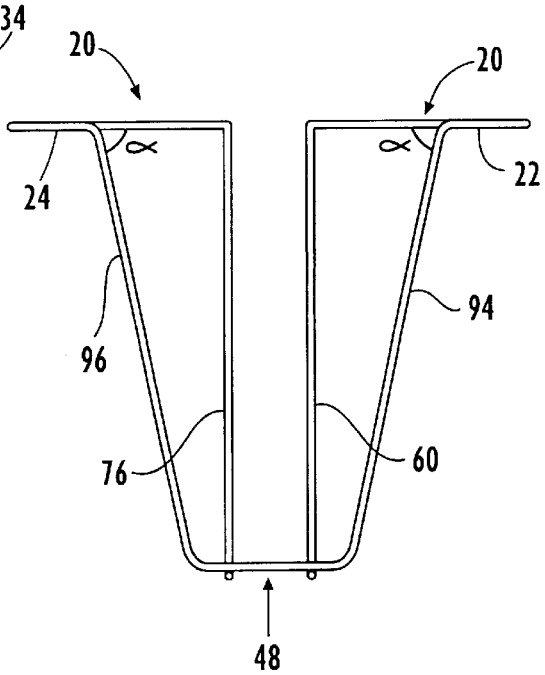
FIG. 20.
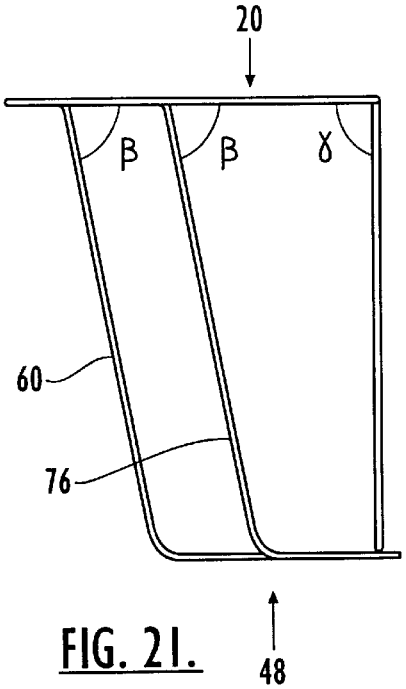
FIG. 21.
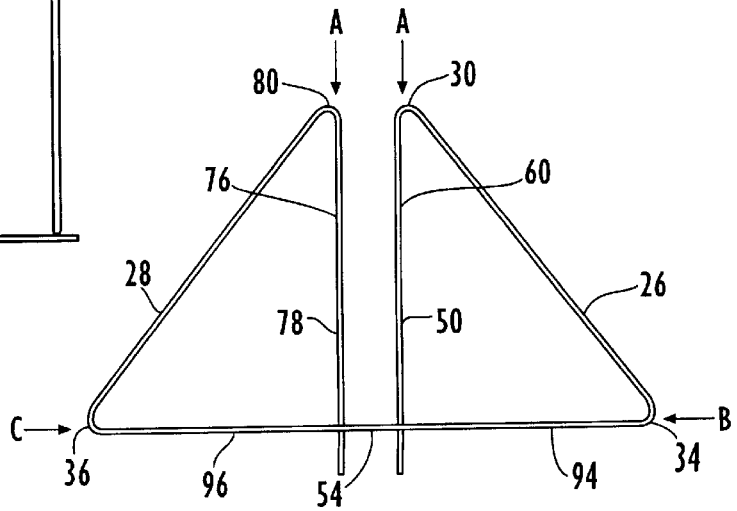
FIG. 22.

FIG. 23.
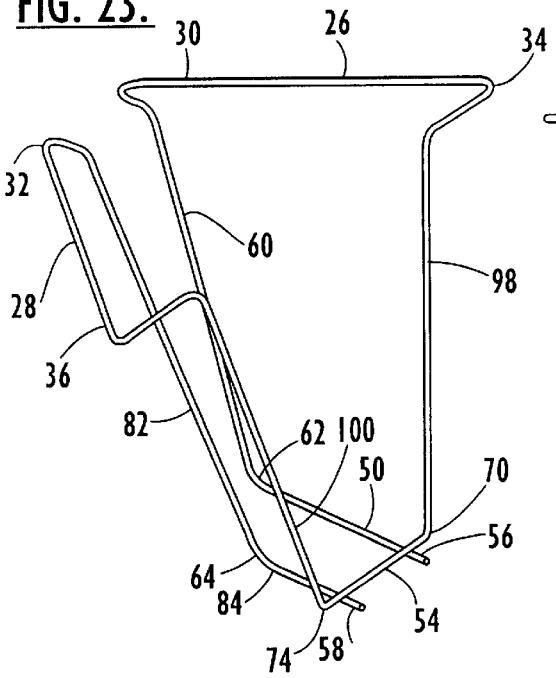
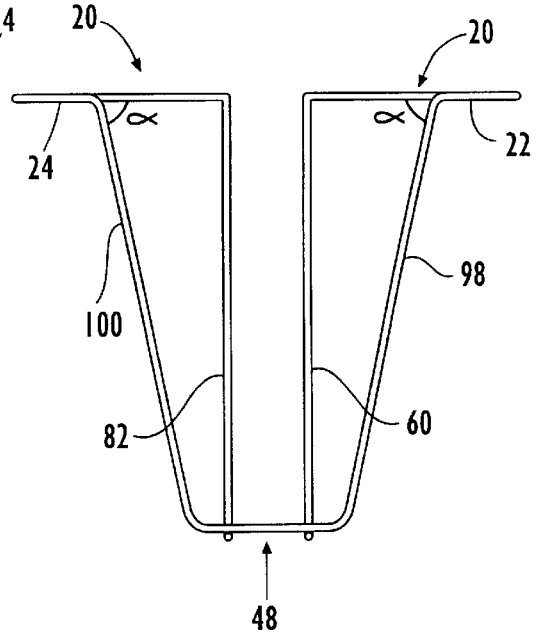
FIG. 24.
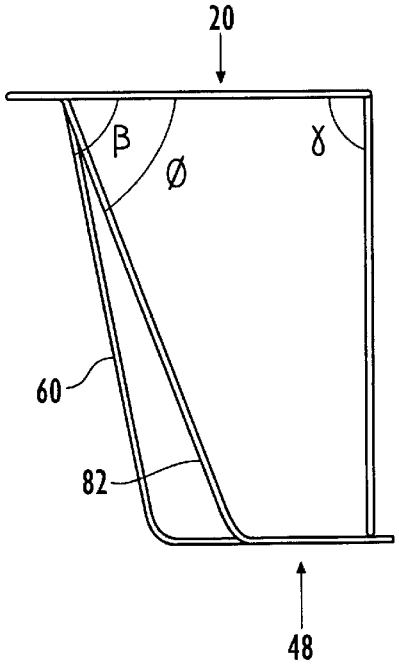
FIG. 25.
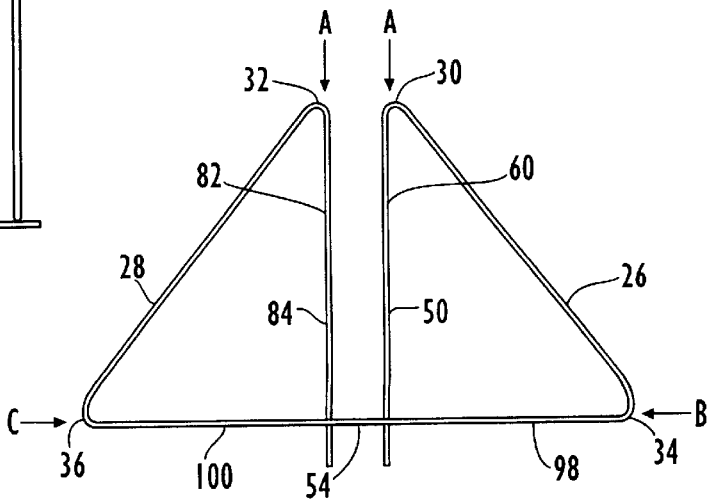
FIG. 26.

BOX SPRING SUPPORT MODULE

FIELD OF THE PRESENT INVENTION

The present invention generally relates to support modules used in a box spring foundation to support rigidly a support surface at a predetermined spacing from a box spring base.

BACKGROUND OF THE PRESENT INVENTION

Typically in the manufacturing process of box springs, a first manufacturer constructs a box spring foundation which includes a support surface and a plurality of support modules. The first manufacturer also may attach a box spring base to the support modules. The box spring foundation is then shipped by the first manufacturer to a bedding manufacturer who secures the support modules to a box spring base, if not done by the first manufacturer, and then applies top padding and a cover to complete the box spring. In addition to consumer preference regarding firmness of box springs, storage and shipping costs are additional factors which control the design of box spring foundations and, in particular, support modules used therein.

Many various types of support modules are known which can support rigidly a support surface at a predetermined spacing from a box spring base and which can be inexpensively stored and shipped during the manufacturing process. For example, Schultz, Jr. et al., U.S. Pat. No. 4,377,279, discloses support modules which are hingedly connected both to the support surface and to the box spring base whereby the box spring foundation can be collapsed for storage and shipment. Furthermore, the support modules can be differently configured to allow for total stiffness or varying degrees of recoilable compression.

In Rodgers et al., U.S. Pat. No. 5,346,188, the support modules are hingedly secured to the support surface by the first manufacturer and the support modules are collapsed against the support surface for storage and shipment. When the box spring is to be completed, the bedding manufacturer extends and secures the support modules to the box spring base during the padding and covering process whereby the support modules provide rigid support of the support surface above the box spring base. Schultz, Jr. et al., U.S. Pat. No. 5,622,357, similarly discloses support modules pivotally secured to the support surface, collapsed for storage and shipment, and later extended and secured to the box spring base by the bedding manufacturer with the support modules rigidly supporting the support surface.

Another type of box spring foundation is disclosed in Hagemeister et al., U.S. Pat. No. 5,052,064, in which support modules are fixedly secured to the support surface whereby the resulting box spring foundations can be nestably stacked for shipment and transport. In particular, the support modules are welded to the support surface by the first manufacturer and later stapled to the box spring base by the bedding manufacturer. Hagemeister et al., U.S. Pat. No. 5,361,434, discloses a similar box spring foundation which includes resilient support springs located between the support modules for resiliently supporting localized loads that are applied to the support surface between the localized areas of the support modules.

An object of the present invention is to provide an additional novel and unobvious type of box spring support module which permits the inexpensive storage and shipment of box spring foundations to bedding manufacturers as discussed above.

SUMMARY OF THE PRESENT INVENTION

Briefly summarized, the present invention includes a box spring foundation having a support surface such as a wire grid assembly and a plurality of nonresilient support modules that firmly support the support surface at a predetermined distance above a box spring base. Each support module includes a single wire form having a top base, a bottom base, and four straight legs rigidly connecting the top and bottom bases of the support module.

In a feature of the present invention the top module includes two upper wire segments each having a predominantly straight wire portion and curved end portions. Each upper wire segment lies in a common plane separate and spaced apart from one another, and each straight wire portion lies in angularly converging mirror image relation to the other straight wire portion.

In a second feature of the present invention, the bottom base includes two predominantly straight wire segments lying adjacent one another and a predominantly straight cross wire segment orthogonally intersecting the adjacent wire segments and being fixedly secured thereto. Moreover, the adjacent wire segments preferably lie in parallel relation to and in a common plane with one another and the cross wire segment secured to both adjacent wire segments maintains the parallel relation therebetween.

In yet a third feature of the present invention, the bottom base is disposed above the top base and four straight and rigid legs extend between the top base and the bottom base, with the bottom base preferably lying in a spaced parallel plane to a plane of the top base. Two of the legs (first pair) extend in a first support plane from the top base to the bottom base in angularly converging mirror image relation to but spaced apart from one another, while one of the other two legs (second pair) extends from the top base to the bottom base towards the first support plane.

In yet another feature of the present invention, the support modules of the present invention are arranged in a box spring foundation whereby the box spring foundation is nestably stackable on top of a second identical box spring foundation, with the bottom bases of the support modules of the box spring foundation being received through the wire grid assembly within the support modules of the second identical box spring foundation.

In a first embodiment of the present invention, a second leg of the second pair of legs is coplanar with the first leg of the second pair of legs and both legs lie in a second support plane at identically disposed distances from the first pair of legs. The second pair of legs preferably lie in spaced parallel relation to one another, and preferably the lower wire segments are of identical lengths and the first and second curved end portions are of identical lengths. The first support plane also preferably intersects the plane of the top base at an angle of approximately 85° and the second support plane preferably intersects the plane of the top base at an angle of approximately 75°.

In a second embodiment of the present invention, the first leg of the second pair of legs lies in the second support plane closer to the first pair of legs than the second leg of the second pair of legs, the lower wire segments are of different lengths, and the first curved end portions are of different lengths.

In yet a third embodiment, the second leg of the second pair of legs extends from the top base to the bottom base out of coplanar relation with the first leg of the second pair of legs, the lower wire segments are of identical length, and the first curved end portions are of different lengths.

Fourth, fifth, and sixth embodiments of the present invention mirror the first, second, and third embodiments of the present invention except that the second support plane extends from the top base plane at an angle 90° instead of approximately 85°.

Preferably, in each of the embodiments the support module is a single length of wire. The top base is welded to the wire grid assembly and each upper wire segment are spaced from the other upper wire segment with first curved end portions thereof lying closer together than second curved end portions thereof. Furthermore, the upper wire segments of some of the support module are welded to at least one of a traverse wire and at least one of a longitudinal wire of the wire grid assembly, and the upper wire segments of some support modules are welded to a border wire of the wire grid assembly. The support modules are also preferably secured to a box spring base by stapling the lower wire segments and the cross wire segment thereto whereby the staples securing the lower wire segments are oriented orthogonally to the staple securing the cross wire segment.

BRIEF DESCRIPTION OF THE DRAWINGS

FIG. 1 is a perspective view of a first embodiment of the support module of the present invention;

FIG. 2 is a front elevational view of the support module of FIG. 1;

FIG. 3 is a side elevational view of the support module of FIG. 1;

FIG. 4 is a top plan view of the support module of FIG. 1;

FIG. 7 is a perspective view of a second embodiment of the support module of the present invention;

FIG. 8 is a front elevational view of the support module of FIG. 7;

FIG. 9 is a side elevational view of the support module of FIG. 7;

FIG. 10 is a top plan view of the support module of FIG. 7;

FIG. 11 is a perspective view of a third embodiment of the support module of the present invention;

FIG. 12 is a front elevational view of the support module of FIG. 11;

FIG. 13 is a side elevational view of the support module of FIG. 11;

FIG. 14 is a top plan view of the support module of FIG. 11;

FIG. 15 is a perspective view of a fourth embodiment of the support module of the present invention;

FIG. 16 is a front elevational view of the support module of FIG. 15;

FIG. 17 is a side elevational view of the support module of FIG. 15;

FIG. 18 is a top plan view of the support module of FIG. 15;

FIG. 19 is a perspective view of a fifth embodiment of the support module of the present invention;

FIG. 20 is a front elevational view of the support module of FIG. 19;

FIG. 21 is a side elevational view of the support module of FIG. 19;

FIG. 22 is a top plan view of the support module of FIG. 19;

FIG. 23 is a perspective view of a sixth embodiment of the support module of the present invention;

FIG. 24 is a front elevational view of the support module of FIG. 23;

FIG. 25 is a side elevational view of the support module of FIG. 23; and FIG. 26 is a top plan view of the support module of FIG. 23.

DETAILED DESCRIPTION OF THE PREFERRED EMBODIMENTS

Figure 5:
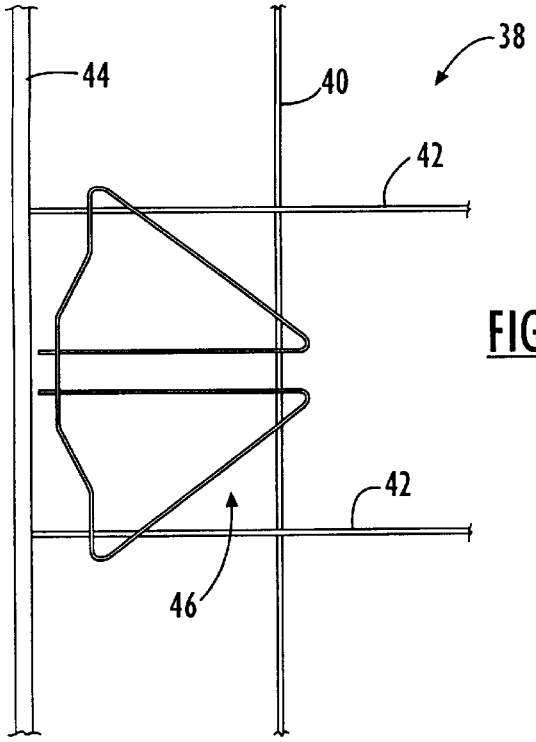
FIG. 5 is atop plan view of the support module of FIG. 1 secured to transverse wires and a longitudinal wire of a wire grid assembly.

Referring now to the Figures, the preferred embodiments ofthe support module ofthe present invention will be discussed wherein like structures will be referred to with like reference numbers.

Generally, the support module of the present invention preferably is a single length of wire configured to define a top base, a bottom base, and four rigid support legs extending between the top base and the bottom base. A first pair of coplanar legs extend from the top base to the bottom base converging mirror image relationship to one another, and a second pair of legs extend from the top base to the bottom base parallel to one another, with the second pair of legs extending towards the bottom base at an incline to the top base towards the first pair of legs. The top base is secured to a support surface of a box spring foundation and the bottom base is secured to a box spring base whereby the support module rigidly supports the box spring support surface at a predefined spacing from the box spring base.

With regard to a first preferred embodiment of the support module of the present invention, the top base 20 consists of two upper wire segments 22,24 each having a predominantly straight wire portion 26,28 and respective first curved end portions 30,32 and second curved end portions 34,36. The upper wire segments 22,24 lie in a first common plane separate and spaced apart from one another with each straight wire portion 26,28 lying in angularly converging mirror image relation to the other, and corresponding curved end portions of each upper wire segment 22,24 are of identical length. The top base 20 is designed to support a conventional box spring wire grid assembly 38 including longitudinal wires 40 and transverse cross wires 42 surrounded by a rectangular border wire 44. Due to the specific configuration of the upper wire segments 22,24, the top base 20 gives an overall trapezoidal impression and, due to this configuration, the top base 20 can be oriented in a number of different ways in securing it to rectangular sections 46 formed by the longitudinal wires 40, the transverse cross wires 42, and the border wire 44. In particular, the two upper wire segments 22,24 of the top base 20 preferably are welded to the longitudinal wires 40 and transverse cross wires 42 of the wire grid assembly 38 as well as to the comers and sides of the rectangular border wire 44 as shown, for example, in FIGS. 5 and 6.

The bottom base 48 of the support module preferably includes two predominantly straight wire segments 50,52 of identical length lying in parallel relation to and in a second common plane with one another and a predominantly straight cross wire segment 54 orthogonally intersecting the parallel wire segments 50,52. The cross wire segment 54 is welded to the two parallel wire segments 50,52 proximate respective first ends 56,58 thereof for maintaining the parallel relation therebetween as well as for providing a rigid bottom base 48 of the support module. Furthermore, the second common plane is preferably parallel with the first common plane containing the top base 20 of the support module.

While other fastening methods may be employed, such as formed and notched metal cross rails, the bottom base 48 of the support module preferably is secured to a box spring base by stapling the parallel wire segments 50,52 and the cross wire segment 54 thereto whereby the staples securing said parallel wire segments 50,52 are oriented orthogonally to the staple securing the cross wire segment 54. This staple orientation resists movement of the bottom base 48 of the support module and, in particular, the staples securing the parallel wire segments 50,52 prevent any rotation of the cross wire segment 54 and the staple of the cross wire segment 54 prevents any rotation of either of the parallel wire segments 50,52.

The predominantly straight four legs of the support module rigidly support the top base 20 above the bottom base 48. In particular, a first leg 60 extends from a first curved end portion 30 of an upper wire segment 22 to a second end 62 of a parallel wire segment 50; a second leg 66 extends from the first curved end portion 32 of the other upper wire segment 24 to a second end 64 of the other parallel wire segment 52; a third leg 68 extends from the second curved end portion 34 of the upper wire segment 22 to a first end 70 of the cross wire segment 54; and a fourth leg 72 extends from the second curved end portion 36 of the second upper wire segment 24 to a second end 74 of the cross wire segment 54. The third leg 68 and fourth leg 72 are coplanar and lie in a first support plane that intersects the top base plane at an angle $\gamma$ of approximately 85°, and the first leg 60 and the second leg 66 lie in a second support plane that intersects the top base plane at an angle $\beta$ of approximately 75°. Furthermore, the two parallel legs 60,66 lie in the second support plane at identically disposed distances respectively from the third leg 68 and fourth leg 72 in the first support to plane as shown in FIG. 3, and the third leg 68 and fourth leg 72 lie in the second support plane in angularly converging mirror image relation to but spaced apart from one another as shown in FIG. 2. Specifically, the third leg 68 and fourth leg 72 form opposed angles $\alpha$ with respect to the second common plane of the support module.

In order for box spring foundations of the present invention to nestably stack, the two parallel legs 60,66 extend towards the other two legs 68,72 in a direction from the top base 20 towards the bottom base 48 and the other two legs 68,72 extend towards one another in a direction from the top base 20 towards the bottom base 48. This inward inclination of the legs 60,66,68,72 permits the nesting of the support modules of a box spring foundation when stacked for storage and shipment. In particular, when two box spring foundations including support modules of the present invention are nested, the bottom base 48 and four legs 60,66,68,72 of a support module are able to be received through the wire grid assembly 38 of another box spring foundation of the present invention within the interior of a support module of the other box spring foundation.

In addition to this nesting, this inclination of the legs 60,66,68,72 allows the legs not only to provide vertical support of the top base 20 above the bottom base 48, but also to provide support of the top base 20 against directional side loads applied horizontally within the top base 20. In particular, with reference to FIG. 4, the four legs 60,66,68,72 of the support module extend from the four curved end portions 30,32,34,36 of the two upper wire segments 22,24 forming the top base 20 towards the bottom base 48. Two of the legs 60,66 extend in closely spaced parallel relation to one another from the more closely spaced converging first end portion 30,32 of the upper wire segments 22,24 to the bottom base 48 and lie in a second support plane inclined at an angle $\beta$ of approximately 75° to the plane of the top base 20 as discussed above. Because of this inclination of 75° to the top base plane, these two legs 60,66 are inclined to support horizontal side loads applied within the top base plane in the direction of arrows A in FIG. 4 to a greater extent than horizontal side loads applied within the top base plane in any other direction. Furthermore, the parallel disposition of this pair of legs 60,66 provides identical dual vertical support of a localized area of the wire grid assembly 38 for selected vertical reinforcement thereof.

The other two legs 68,72 extend in a first support plane inclined at an angle $\gamma$ of approximately 85° to the top base plane and each leg 68,72 extends at an angle $\alpha$ to the top base plane in mirror image relation to the other respective leg 68,72, also as discussed above. Because of this orientation of this pair of legs 68,72, these legs support the top base 20 against horizontal side loads applied within the top base plane in the directions of arrows B,C in FIG. 4 respectively to a greater extent than horizontal side loads applied within the base plane in any other direction. Furthermore, if the inclination of this pair of legs 68,72 is greater than the inclination of the pair of legs 60,66, then the horizontal side load support of this pair of legs 68,72 will be greater in their respective directions of arrows B,C than the side load support provided by the pair of legs 60,66 in the direction of arrows A.

In another embodiment of the support module as shown in FIGS. 7–10, the second leg 76 and first leg 60 remain coplanar in a second support plane but the second leg 76 is disposed closer to the pair of legs 68,72 than the first leg 60. This is accomplished by providing different lengths of the curved end portions 30,80 of the upper wire segments 22,24 respectively whereby the second leg 76 and first leg 60 extend from the top base 20 to the bottom base 48 in staggered relation as shown in FIG. 9. In particular, the support module of FIGS. 1–4 is modified by increasing the length of the first curved end portion 80 of upper wire segment 24 and decreasing the length of the lower parallel wire segment 78 in order to arrive at the support module of FIGS. 7–10. This embodiment varies the localized vertical support of the wire grid assembly 38 by the second pair of legs of the support module from that of the embodiment of the support module of FIGS. 1–4.

In a third embodiment of the support module of the present invention as shown in FIGS. 11–14, the angle $\theta$ of the second leg 82 with the top base plane is slightly decreased from 75°, thereby increasing the support provided against the horizontal side load applied in direction A of FIG. 4 against first curved end portion 32. In order to accomplish this decrease in inclination, a parallel wire segment 84 is decreased in length compared with the other parallel wire segment 50 while the first curved end portions 30,32 of the upper wire segments 22,24 are maintained at equal lengths. Thus, in this embodiment the second leg 82 is not coplanar with the first leg 60.

The present invention further contemplates the combination of these two previous variations in the support module of FIGS. 1–4. In particular, in such a support module the angle of the second leg with the top base plane would differ from the angle of the first leg with the top base plane, and the second leg and first leg would extend from the top base to the bottom base in staggered non-coplanar relation.

In the fourth, fifth, and sixth embodiments of the support module of the present invention found in FIGS. 15–18, 19–22, and 23–26, respectively, these embodiments vary from the embodiments of the support modules of FIGS. 1–4, 7–10, and 11–14 only with respect to the angle γ formed between the first support plane and the top base plane. Whereas in the first three embodiments γ was approximately 85°, in the fourth, fifth, and sixth embodiments γ is 90°. Thus, the third leg 90 and fourth leg 92 of the fourth embodiment, the third leg 94 and fourth leg 96 of the fourth embodiment, and the third leg 98 and fourth leg 100 of the fourth embodiment each provide a maximum localized vertical support of the box spring support surface. Furthermore, it is also contemplated that the modifications of the fourth embodiment to form the fifth and sixth embodiments can be combined just as the modifications of the first embodiment to form the second and third embodiments can be combined as discussed above.

Figure 6:
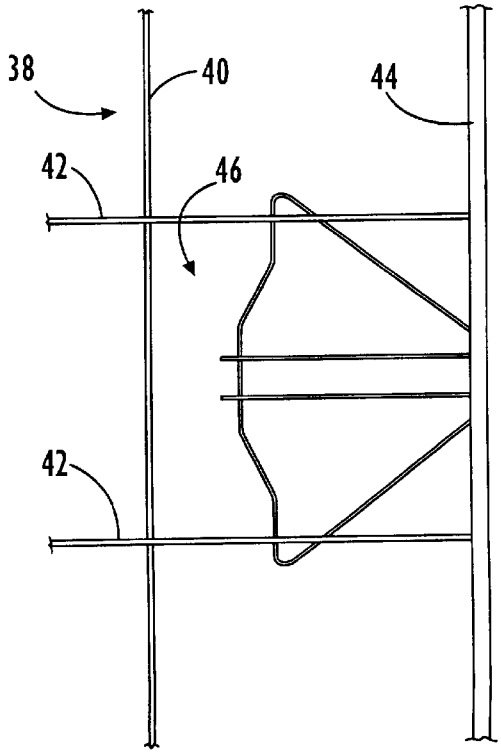
FIG. 6 is a top plan view of the support module of FIG. 1 secured to transverse wires and a border wire of a wire grid assembly.

As will now be apparent to one of ordinary skill in the art, during assembly of a box spring foundation of the present invention, the top bases of the support modules are welded to the cross wires, line wires, and border wire of the grid assembly as shown in FIGS. 5 and 6, for example, and the bottom bases are attached to slats of a frame of the box spring by stapling or otherwise fastening the base wire segments to the slats as discussed above. Furthermore, as discussed above, each support module provides support in the primary, vertical direction as well as directional support in the top base plane against side loads. Thus, because of the modular support modules and each support module's ability to be attached to the wire grid assembly in one of various orientations during assembly of the box spring foundation, various direction specific support characteristics can be designed into the box spring foundation as desired.

It will therefore be readily understood by those persons skilled in the art that the present invention is susceptible of a broad utility and application. Many embodiments and adaptations of the present invention other than those herein described will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A support module for use in a box spring foundation to support a support surface above a box spring base, said support module including a substantially horizontal top base comprising two wire segments each having a predominantly straight wire portion and curved end portions, each said wire segment being spaced apart from one another and lying in a common plane and each said straight wire portion lying in angularly converging mirror image relation to each other.

2. A support module according to claim 1 consisting of a single length of wire.

3. A support module for use in a box spring foundation to support a support surface above a box spring base, said support module including a bottom base comprising two predominantly straight wire segments lying adjacent each other and a predominantly straight cross wire segment intersecting and extending across and beyond said adjacent wire segments and being fixedly secured thereto.

4. A support module according to claim 3 wherein said adjacent wire segments lie in parallel relation to and in a common plane with each other and said cross wire segment orthogonally intersects said parallel wire segments and is fixedly secured thereto for maintaining said parallel relation therebetween.

5. A support module according to claim 3 consisting of a single length of wire.

6. A support module for use in a box spring foundation to support a support surface above a box spring base, said support module consisting of a single length of wire and including a top base, a bottom base disposed in a spaced parallel plane to a plane of said top base, and four predominantly straight legs extending between said top base and said bottom base, a first pair of said legs extending in a first support plane from the top base to the bottom base in angularly converging mirror image relation to but spaced from one another, and one leg of a second pair of said legs extending from the top base to the bottom base towards said first suport plane.

7. A support module for use in a box spring foundation to support a support surface above a box spring base, said support module including a top base, a bottom base disposed in a spaced parallel plane to a plane of said top base, and four predominantly straight legs extending between said top base and said bottom base, a first pair of said legs extending in a first support plane from the top base to the bottom base in angularly converging mirror image relation to but spaced from one another, said first support plane orthogonally intersecting said top base plane, and one leg of a second pair of said legs extending from the top base to the bottom base towards said first support plane.

8. A support module for use in a box spring foundation to support a support surface above a box spring base, said support module including a top base, a bottom base disposed in a spaced parallel plane to a plane of said top base, and four predominantly straight legs extending between said top base and said bottom base, a first pair of said legs extending in a first support plane from the top base to the bottom base in angularly converging mirror image relation to but spaced from one another, and a second pair of said legs each non coplanar to the other but both extending from the top base to the bottom base towards said first support plane.

9. A support module for use in a box spring foundation to support a support surface above a box spring base, said support module including a top base, a bottom base disposed in a spaced parallel plane to a plane of said top base, and four predominantly straight legs extending between said top base and said bottom base, a first pair of said legs extending in a first support plane from the top base to the bottom base in angularly converging mirror image relation to but spaced from one another, and a second pair of said legs extending in a second support plane from the top base to the bottom base in spaced parallel relation to one another.

10. A support module for use in a box spring foundation to support a support surface above a box spring base, said support module including a top base, a bottom base disposed in a spaced parallel plane to a plane of said top base, and four predominantly straight legs extending between said top base and said bottom base, a first pair of said legs extending in a first support plane from the top base to the bottom base in angularly converging mirror image relation to but spaced from one another, and a second pair of said legs extending in a second support plane from the top base to the bottom base, a first leg of said second pair lying closer to said first pair of legs than a second leg of said second pair of legs.

11. A support module for use in a box spring foundation to support a support surface above a box spring base, said support module including a top base, a bottom base disposed in a spaced parallel plane to a plane of said top base, and four predominantly straight legs extending between said top base and said bottom base, a first pair of said legs extending in a first support plane from the top base to the bottom base in angularly converging mirror image relation to but spaced from one another, and a second pair of said legs extending in a second support plane from the top base to the bottom base, said first support plane intersecting said plane of said top base at an angle of approximately 85°.

12. A support module for use in a box spring foundation to support a support surface above a box spring base, said support module including a top base, a bottom base disposed in a spaced parallel plane to a plane of said top base, and four predominantly straight legs extending between said top base and said bottom base, a first pair of said legs extending in a first support plane from the top base to the bottom base in angularly converging mirror image relation to but spaced from one another, and a second pair of said legs extending in a second support plane from the top base to the bottom base, said second support plane intersecting said plane of said top base at an angle of approximately 75°.

13. A box spring foundation comprising a wire grid assembly and support modules, each support module including an independent wire form configured to define a top base, a bottom base, and four predominantly straight legs interconnecting the top base to the bottom base, said top base being secured to said wire grid assembly, wherein:

a. said top base comprises two upper wire segments having predominantly straight wire portions and respective first and second curved end portions, each said upper wire segment being spaced from the other and lying in a first common plane with said first curved end portions lying closer together than said second curved end portions thereof, each said straight wire portion lying in angularly converging mirror image relation to said other straight wire portion;

b. said bottom base comprises two predominantly straight lower wire segments lying in parallel relation to and in a second common plane with one another and a predominantly straight cross wire segment orthogonally intersecting said lower wire segments proximate first ends thereof and being fixedly secured thereto for maintaining said parallel relation therebetween, said first common plane being parallel with said second common plane;

c. a first leg of said four legs extends from said first curved end portion of one of said upper wire segments to a second end of one of said lower wire segments;

d. a second leg of said four legs extends from said first curved end portion of the other of said upper wire segments to a second end of the other of said lower wire segments;

e. a third leg of said four legs extends from said second curved end portion of said one upper wire segment to a first end of said cross wire segment; and f. a fourth leg of said four legs extends from said second curved end portion of said second upper wire segment to a second end of said cross wire segment.

14. A box spring foundation according to claim 13 wherein a said support module consists of a single length of wire.

15. A box spring foundation according to claim 13 wherein said upper wire segments of a said support module are welded to at least one of a traverse wire and at least one of a longitudinal wire of said wire grid assembly.

16. A box spring foundation according to claim 13 wherein said upper wire segments of a said support module are welded to a border wire of said wire grid assembly.

17. A box spring foundation according to claim 13 wherein at least one of a said support module is secured to a box spring base by stapling said lower wire segments and said cross wire segment thereto whereby the staples securing said lower wire segments are oriented orthogonally to said staple securing said cross wire segment.

18. A box spring foundation according to claim 13 wherein all of said support modules are arranged so that a said box spring foundation is nestably stackable on top of a second identical box spring foundation, said bottom bases of said support modules of said box spring foundation being received through said wire grid assembly within said support modules of said second identical box spring foundation.

19. A box spring foundation according to claim 13 wherein said third and fourth legs lie in a first support plane in angularly converging mirror image relation to but spaced apart from one another.

20. A box spring foundation according to claim 19 wherein said first leg extends from said top base to said bottom base towards said first support plane.

21. A box spring foundation according to claim 20 wherein said second leg extends in coplanar relation to said first leg.

22. A box spring foundation according to claim 21 wherein said first and said second legs lie in spaced parallel relation to one another.

23. A box spring foundation according to claim 13 wherein said lower wire segments are of identical length.

24. A box spring foundation according to claim 13 wherein said lower wire segments are of different lengths.

25. A box spring foundation according to claim 24 wherein said first curved end portions are of identical lengths.

26. A box spring foundation according to claim 24 wherein said first curved end portions are of different lengths.

* * * * *